US008152167B2

(12) United States Patent
Saito et al.

(10) Patent No.: US 8,152,167 B2
(45) Date of Patent: Apr. 10, 2012

(54) PRINTING APPARATUS HAVING OPTICAL SENSOR UNIT

(75) Inventors: Hiroyuki Saito, Yokohama (JP); Haruo Uchida, Yokohama (JP); Kenji Shigeno, Yokohama (JP); Noriyuki Aoki, Tokyo (JP); Kazuhisa Kawakami, Yokohama (JP); Yuji Kanome, Yokohama (JP); Kosuke Yamamoto, Yokohama (JP); Masakazu Tsukuda, Tokyo (JP); Yoshiaki Suzuki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 12/633,860

(22) Filed: Dec. 9, 2009

(65) Prior Publication Data

US 2010/0148426 A1 Jun. 17, 2010

(30) Foreign Application Priority Data

Dec. 17, 2008 (JP) ..... 2008-320811

(51) Int. Cl.
*B65H 7/02* (2006.01)

(52) U.S. Cl. ..... 271/265.01; 271/10.03

(58) Field of Classification Search ..... 271/110, 271/10.03, 265.01
See application file for complete search history.

(56) References Cited

U.S. PATENT DOCUMENTS

| | | | | |
|---|---|---|---|---|
| 4,657,236 | A * | 4/1987 | Hirakawa et al. | 271/99 |
| 4,778,296 | A | 10/1988 | Takahashi | |
| 5,157,444 | A | 10/1992 | Mori et al. | |
| 5,177,547 | A | 1/1993 | Kanemitsu et al. | |
| 5,620,174 | A | 4/1997 | Taniguro et al. | |
| 5,754,213 | A | 5/1998 | Whritenor | |
| 6,017,160 | A | 1/2000 | Sato et al. | |
| 6,764,071 | B2 * | 7/2004 | Hoberock | 271/109 |
| 6,834,177 | B2 | 12/2004 | Saito et al. | |
| 6,939,064 | B2 | 9/2005 | Kawaguchi et al. | |
| 7,104,710 | B2 | 9/2006 | Otsuka | 400/76 |
| 7,641,814 | B2 | 1/2010 | Lynch et al. | |
| 2003/0128373 | A1 | 7/2003 | Hayashi et al. | |
| 2005/0053408 | A1 | 3/2005 | Otsuka | |
| 2007/0090592 | A1 * | 4/2007 | Nakada | 271/265.01 |
| 2007/0201935 | A1 | 8/2007 | Mizutani | |
| 2007/0217821 | A1 * | 9/2007 | Azuma et al. | 399/159 |
| 2008/0073832 | A1 | 3/2008 | Sudo et al. | |
| 2009/0001662 | A1 * | 1/2009 | Matsumoto | 271/278 |
| 2009/0166964 | A1 * | 7/2009 | Fukasawa | 271/265.01 |
| 2009/0322819 | A1 | 12/2009 | Hayashi et al. | |

FOREIGN PATENT DOCUMENTS

| | | |
|---|---|---|
| JP | 2005-280210 | 10/2005 |
| JP | 2005280210 A * | 10/2005 |

OTHER PUBLICATIONS

European Official Action, dated Mar. 11, 2010, issued by the European Patent Office, in Application No. 09178539.4. Chinese Office Action dated Apr. 20, 2011, issued by the State Intellectual property Office of P.R. China, in counterpart Chinese Patent Application No. 200910261227.0.

* cited by examiner

*Primary Examiner* — Jeremy R Severson
(74) *Attorney, Agent, or Firm* — Fitzpatrick, Cella, Harper & Scinto

(57) ABSTRACT

A printing apparatus has a sensor unit which optically detects, at a measurement position, a surface of a sheet, for measuring a moving state of the sheet. The sensor unit measures the moving state of the sheet when the sheet is located at the measurement position, and measures a moving state of a surface of the rotary member when the sheet is not located at the measurement position. The sensor unit has at least one of an image sensor arranged to perform imaging of one of the surface of the sheet and the surface of the rotary member so as to obtain image data, based on which the moving state is measured and a Doppler velocity sensor.

14 Claims, 9 Drawing Sheets

PRINTING APPARATUS HAVING OPTICAL SENSOR UNIT

BACKGROUND OF THE INVENTION

1. Field of the Invention

The present invention relates to a printing apparatus which conveys a sheet and forms an image on the sheet.

2. Description of the Related Art

In order to realize formation of a high-grade image by a printing apparatus, a sheet-like printing medium (herein, simply referred to as a "sheet") is required to be conveyed with high accuracy.

Recently, in order to improve accuracy in conveyance control, a direct sensor which performs direct detection of a movement amount of the sheet has been realized practically. The direct detection is conducted by imaging a surface of the sheet so as to perform image processing on the image of the sheet surface. For example, U.S. Pat. No. 7,104,710 discloses a technology for performing the conveyance control using the direct sensor. In an apparatus disclosed in the above-mentioned U.S. Patent, the direct sensor is provided on a carriage in which a print head is installed, or at a position which faces a surface of a discharge port of the print head.

SUMMARY OF THE INVENTION

In known structures, the direct sensor performs imaging only at a fixed position in a conveyance direction of the sheet. Therefore, during conveyance of the sheet, there disadvantageously exists a period during which sensing cannot be performed because the sheet is not located at a measurement position for the direct sensor (hereinafter, this period is referred to as "sensing disabled period"). For example, there is a case of performing image printing by a multipath method when printing is performed onto a trailing edge or a leading edge of the sheet. In such case, when the edge portion of the sheet deviates from the measurement position and the sensing is disabled, it is impossible to perform conveyance control with high accuracy by direct sensing. Therefore, there is a problem in that image quality at the edge portion of the sheet cannot be guaranteed.

An object of the present invention is therefore to provide a printing apparatus capable of reducing the sensing disabled period of the direct sensor.

According to the present invention, there is provided a printing apparatus, comprising a conveying mechanism configured to convey a sheet, the conveying mechanism comprising a rotary member; and a sensor unit configured to optically detect a measurement position on the rotary member, wherein the sensor unit is further configured to measure a moving state of the sheet when the sheet is located at the measurement position, and to measure a moving state of a surface of the rotary member when the sheet is not located at the measurement position.

Further features of the present invention will become apparent from the following description of exemplary embodiments with reference to the attached drawings.

DESCRIPTION OF THE EMBODIMENTS

Hereinafter, embodiments of the present invention are described with reference to the drawings. Note that constituent elements described in the embodiments are merely examples, and the scope of the present invention is not limited thereby.

The present invention is applicable to various fields of movement detection as typified by a printing apparatus. In these fields, it is desirable to detect movement of a sheet-like object with high accuracy. Specifically, the present invention is applicable to an apparatus such as a printing apparatus and a scanner, and to an apparatus which conveys an object to perform various processes on the object such as inspection, reading, working, and marking in a processing unit, and which is used in an industrial field, a production field, a distribution field, and the like. In the case of applying the present invention to the printing apparatus, the present invention is applicable not only to a single-function printer, but also to a combined apparatus having a copying function, an image scanning function and so on, that is, a so-called multi-function printer. The present invention is applicable to a printer of various printing methods such as an ink-jet method, an electrophotographic method, and a thermal transfer method.

Figure 1:
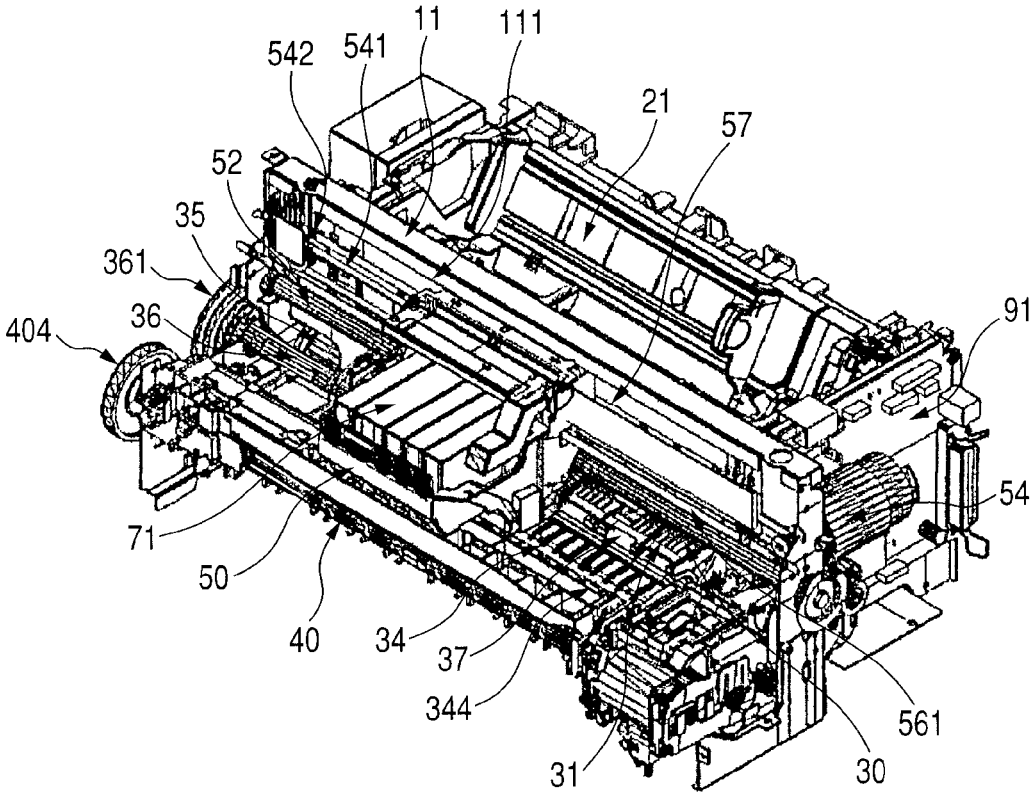
FIG. 1 is a perspective view illustrating an entire structure of a printing apparatus according to a first embodiment of the present invention.
Figure 2:
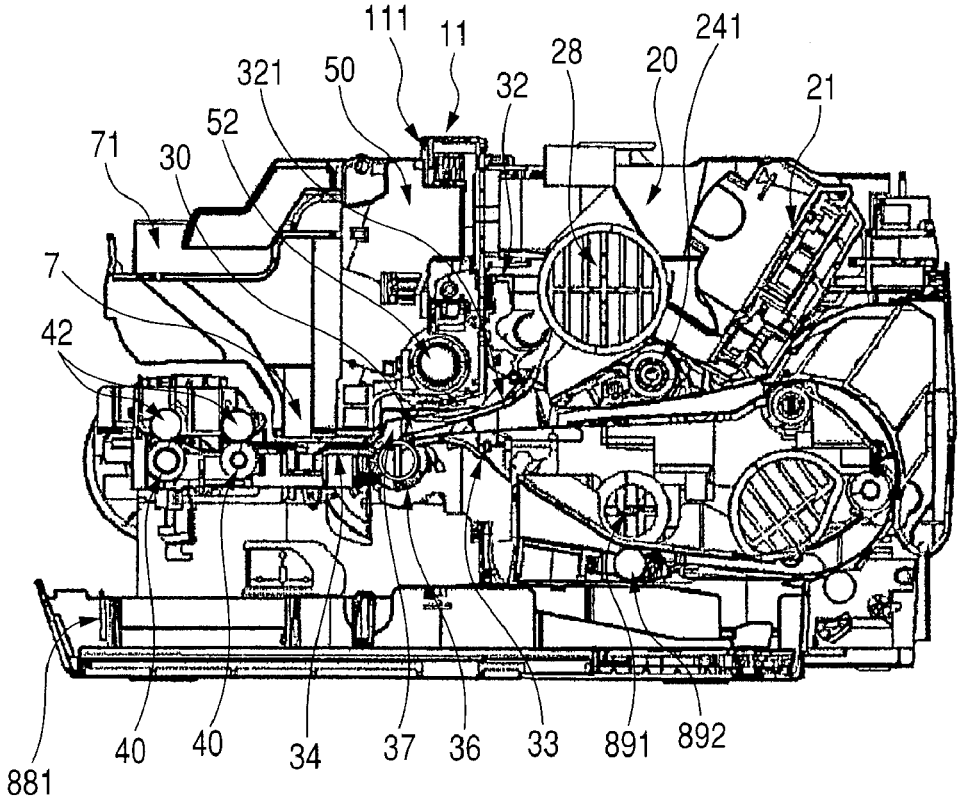
FIG. 2 is a cross-sectional view of the printing apparatus illustrated in FIG. 1.

Hereinafter, description is made of a first embodiment in which the present invention is applied to the ink-jet printing apparatus. FIG. 1 and FIG. 2 are a perspective view and a cross-sectional view respectively, each illustrating an entire structure of the printing apparatus. Roughly speaking, the printing apparatus includes a sheet-supplying unit for supplying a sheet, a sheet-feeding unit for conveying and feeding the supplied sheet, a printing unit for forming an image on the sheet, and a sheet-ejecting unit for ejecting the sheet. The sheet-feeding unit and the sheet-ejecting unit constitute a conveying mechanism.

In the sheet-supplying unit, a pressure plate 21 on which sheets (hereinafter, sometimes referred to as "print sheet(s)") P are stacked, a sheet-supplying roller 28 for supplying the sheet P, a separating roller 241 for separating the sheet P from other sheets, a returning lever for returning the sheet P to a stacked position, etc., are attached to a base 20 of the sheet-supplying unit. A sheet-supplying tray for retaining the stacked sheet P is attached to the base 20 or to an outer covering of the sheet-supplying unit. Further, it is also possible to supply the sheet from a detachable cassette 881.

A description of the sheet-feeding unit constituting the conveying mechanism follows. A conveying roller 36 (hereinafter, sometimes referred to as "first conveying roller") is a rotary member positioned on an upstream side of a print head 7 which will be described later. The conveying roller 36 has a metal shaft whose surface is coated with microparticles of ceramic. Metal portions at both ends of the conveying roller 36 are supported by bearings attached to a chassis 11. The conveying roller 36 is provided with multiple pinch rollers 37 and drives the pinch rollers in a contact manner. Each of the pinch rollers 37 is retained in a pinch-roller holder 30. The pinch rollers 37 are biased by a pinch-roller spring 31, thereby to be brought into pressured contact with the conveying roller 36. As a result, a conveying force between the conveying roller 36 and the pinch rollers 37 for the sheet P is generated. At an entrance of the sheet-feeding unit to which the sheet P is conveyed from the sheet-supplying unit, a paper-guide flapper 33 for guiding the sheet P and a platen 34 are provided. The platen 34 is attached to the chassis 11 and fixed in position. Further, the pinch-roller holder 30 is provided with a sensor lever 321 and a PE-sensor 32 (Paper End Sensor)). The sensor lever 321 operates (i.e. moves) when a leading edge or a trailing edge of the sheet P passes the sensor lever 321, and the sensor 32 measures the operation (or movement) of the sensor lever 321.

The sheet P fed from the sheet-supplying unit to the sheet-feeding unit is guided by the pinch-roller holder 30 and the paper-guide flapper 33, thereby to be fed between a pair of roller assemblies consisting of the conveying roller 36 comprising preferably a single roller and a pinch roller assembly 37 (which comprises an array of aligned pinch rollers in a preferred embodiment, but which may comprise a single cylinder). At this time, the leading edge of the sheet P is measured by the sensor lever 321, to thereby obtain a print position on the sheet P. Then, the sheet P is conveyed on the platen 34 by rotation of the conveying roller 36 and the pinch rollers 37, the rotation being caused by a conveying motor 35.

The printing unit is described next. On a downstream side of the sheet-feeding unit in the conveyance direction of the conveying roller 36, there is provided the printing unit including the print head 7 for forming the image based on image information. The print head 7 is an ink-jet print head in which ink tanks 71 for respective colors are installed, the ink tanks 71 being replaceable separately. In the print head 7, by giving a discharging energy to the ink by a heater or a piezoelectric element, the ink is discharged from the nozzle. As a result, the image is formed on the sheet P.

At a position facing the nozzle of the print head 7, the platen 34 for supporting the sheet P is provided. The platen 34 is provided with a platen absorber 344 for absorbing the ink overflowing from edges of the sheet P, for example when entire-surface printing (borderless printing) is performed.

The print head 7 is attached to a carriage 50. The carriage 50 is supported by a guide shaft 52 and a guide rail 111. The guide shaft 52 causes the carriage 50 to perform reciprocal scanning in a direction orthogonal to the conveyance direction of the sheet P, and the guide rail 111 holds an end of the carriage 50 and maintains a space between the print head 7 and the sheet P. Note that in the illustrated embodiment, the guide shaft 52 is attached to the chassis 11, and the guide rail 111 is formed integrally with the chassis 11.

The carriage 50 is driven, with an intermediary in the form of a timing belt 541, by a carriage motor 54 attached to the chassis 11. The timing belt 541 is stretched and supported by an idle (or idler) pulley 542. A code strip 561 provided with markings at a pitch of 150 to 300 marks per inch (or approximately 60 to 120 marks per cm) for measuring the position of the carriage 50 is provided parallel to the timing belt 541. Further, an encoder sensor for reading the code strip 561 is provided on a carriage substrate installed in the carriage 50. The carriage substrate includes a contact for making electrical connection with the print head 7, and a flexible cable 57 for transmitting a signal from a controller 91 to the print head 7. The controller 91 is a control unit for performing various controls of the entire apparatus. The control unit includes a central processing unit (CPU), a memory, and various input/output (I/O) interfaces.

In the above-mentioned structure, when forming the image onto the sheet P, a roller assembly pair, that is, the conveying roller 36 and the pinch roller(s) 37, conveys and stops the sheet P at the position at which the image is to be formed. Then, while the carriage motor 54 causes the carriage 50 to perform scanning, the print head 7 discharges the ink toward the sheet P in response to the signal from the controller 91. A desired image is formed on the sheet P by alternately repeating the steps of conveying the sheet P by a predetermined amount using the roller assembly pair, and scanning of the carriage including discharge of the ink onto the sheet.

The sheet-ejecting unit constituting the conveying mechanism will now be described. The sheet-ejecting unit includes two sheet-ejecting rollers (hereinafter, sometimes referred to as "second conveying rollers") 40 to which rotary members are positioned downstream of the print head 7. Further, the sheet-ejecting unit includes spurs 42 and a gear row. The spurs 42 come into contact with the sheet-ejecting rollers 40 with a predetermined pressure, and are rotatable together with the sheet-ejecting rollers 40. The gear row transmits the driving force of the (first) conveying roller 36 to the (second) sheet-ejecting rollers 40. The sheet P onto which the image is formed is nipped between the sheet-ejecting rollers 40 and the spurs 42, and conveyed and ejected by rotation of the sheet-ejecting rollers 40 and the rotation of the spurs 42 driven by the rotation of the sheet-ejecting rollers 40.

The apparatus according to this embodiment is capable of performing double-sided printing onto the sheet P. The sheet P passes between the conveying roller 36 and the pinch rollers 37 and, at the same time, printing is performed by the print head 7 on the surface of the sheet P. At the time of automatic double-sided printing, the sheet P which passes between the conveying roller 36 and the pinch rollers 37 is fed back between the conveying roller 36 and the pinch rollers 37 by the above-mentioned sheet-ejecting rollers 40 and the spurs 42. As a result, the trailing edge of the sheet P is nipped between the conveying roller 36 and the pinch rollers 37 again, and conveyed in the reverse direction. The sheet P which is fed again is then nipped between a double-sided roller 891 and the double-sided pinch roller 892, and then conveyed using a guide. A sheet-conveyance path for double-sided printing joins a sheet-conveyance path for the above-mentioned U-turn conveyance. Therefore, the sheet-conveyance path thereafter is the same as the above in structure and effect. Then, printing is performed in a state in which a back surface (surface not subjected to printing) faces the print head 7 to be printed upon (and may also be in a state in which the print sheet is reversed compared to the first printing direction).

Figure 3:
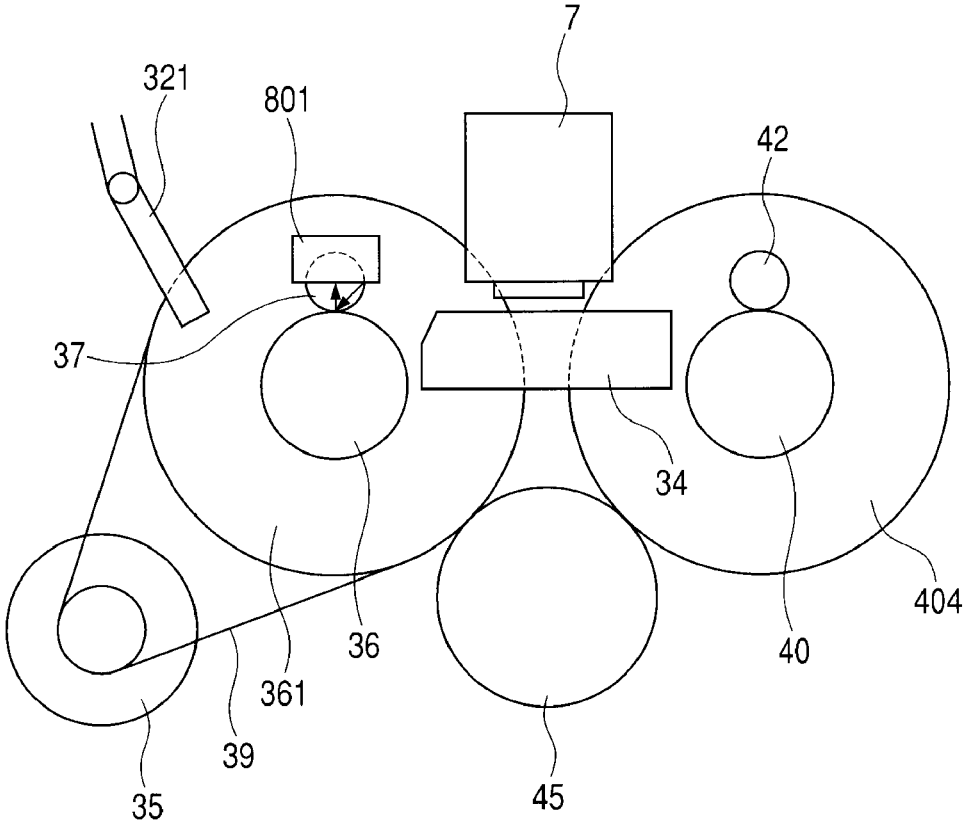
FIG. 3 is a diagram illustrating a structure of a conveying mechanism.

FIG. 3 is a schematic view of the conveying mechanism. For simplifying the description, FIG. 3 illustrates only one of the two conveying rollers 40. The sheet P is nipped between the first conveying roller 36 and the pinch rollers 37, and then conveyed. The first conveying roller 36 is arranged on the further upstream side in the conveyance direction compared with the print head 7, and the pinch rollers 37 which face the first conveying roller 36 are pressed and driven thereby. The sheet P passes on the platen 34 which is arranged so as to face the print head 7 and in order to maintain the sheet P at a certain height relative to the print head. The sheet P is then fed to the downstream side. The sheet P is nipped between the second conveying rollers 40 and the spurs 42, and conveyed to the sheet-ejecting unit. The second conveying rollers 40 are positioned on the downstream side in the conveyance direction compared with the print head 7, and the spurs 42 which face the second conveying rollers 40 are pressed and driven thereby. The first conveying roller 36 and the second conveying rollers 40 receive the driving force from a conveying motor 35 through a transmission belt 39, a first-conveying-roller gear 361 pressed into the first conveying roller 36, an idler gear 45, and a second-conveying-roller gear 404.

The sheet-feeding unit includes the sensor lever 321 for measuring each of the leading edge and the trailing edge of the sheet P, and a direct-sensor unit 801 capable of accurately measuring the conveyance amount of the sheet P. The direct-sensor unit 801 serves as a sensor unit which optically detects the surface of the sheet P and measures the moving state of the sheet P. As will be described later, the direct-sensor unit 801 is capable of measuring not only the sheet but also the moving state of the surface of the rotating roller.

Figure 9:
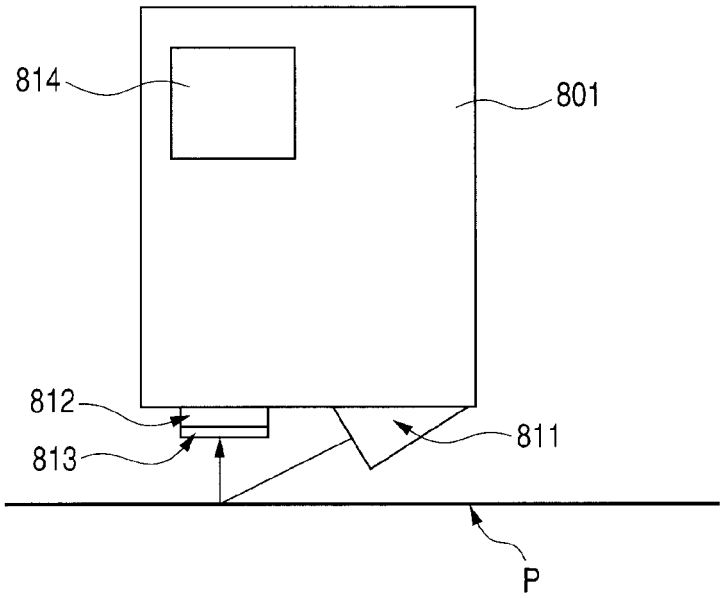
FIG. 9 is a diagram illustrating a structure of the direct-sensor unit.

FIG. 9 illustrates the structure of the direct-sensor unit 801. The direct sensor 801 includes a light source 811 and a light-receiving portion 812 for receiving light from the light source 811 reflected from an object of observation (such as a sheet P). As an image sensor in the light-receiving portion 812, a charge coupled device (CCD) image sensor or a complementary metal oxide semiconductor (CMOS) image sensor is used. In a light path extending from the light source 811 to the light-receiving portion 812, a lens 813 is provided. Further, there is provided a signal processing section 814 for storing and processing image data obtained by a light-receiving element of the light-receiving portion 812. The signal processing for direct sensing may be performed by the controller 91 or by a separate signal processing section 814.

Figures 10A, 10B, 10C:
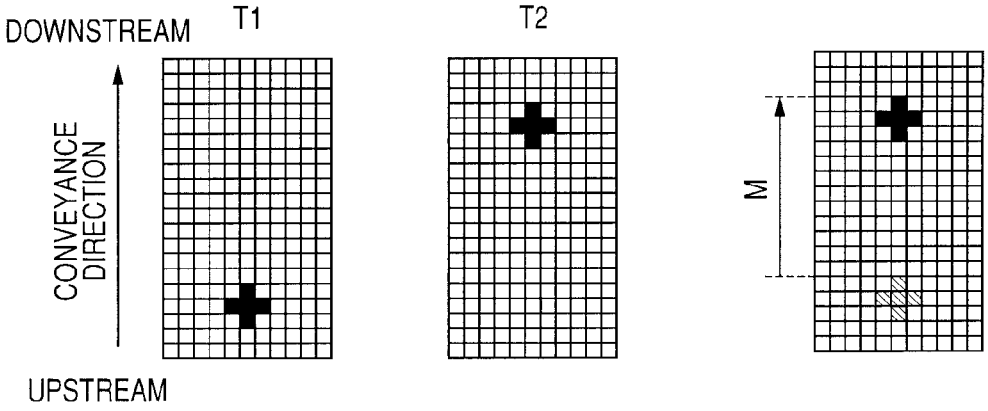
FIGS. 10A, 10B and 10C are diagrams illustrating a principle of direct sensing.

FIGS. 10A to 10C are diagrams illustrating a principle of the direct sensing. FIG. 10A illustrates image data obtained by imaging performed by one image sensor at a time T1. FIG. 10B illustrates image data obtained by imaging performed at a time T2, that is, when the sheet is slightly moved after the time T1. By a signal processing including a well-known pattern matching process, it is determined whether or not a pattern exists in the image data of FIG. 10B that is the same as a pattern in a given region of the image data of FIG. 10A exists in the image data of FIG. 10B (though a cross pattern is used in this case, any pattern may be used in fact). As a result of the determination, it is possible to obtain a movement amount M of a medium based on a displacement amount (number of pixels) therebetween as illustrated in FIG. 10C. Further, by dividing the movement amount M by a period of time between the times T1 and T2, it is possible to obtain a moving speed of the sheet during the period of time.

In FIG. 3, the direct-sensor unit 801 is arranged at a position which faces the uppermost surface of the first conveying roller 36 in the conveyance path of the sheet P, the position being that at which imaging is performed with respect to the surface of the sheet P. Paths of illuminated light and received light of the direct-sensor unit 801 are each indicated by an arrow. In FIG. 3 (diagram viewed in a sectional direction), although the direct-sensor unit 801 and the pinch rollers 37 seem, when viewed from along the axis of the pinch rollers, to overlap with each other, the direct-sensor unit 801 and the pinch rollers 37 may in fact be arranged in a positional relationship in which they are spaced apart along the axial direction. The pinch rollers may be a series of short cylinders that are respectively aligned in the axial direction. The direct-sensor unit 801 may be positioned between the aligned pinch rollers, in order to perform imaging by illuminating the surface of the conveying roller in a region between the separately arranged pinch rollers adjacent to each other. Alternatively, the direct-sensor unit 801 may be at a position further outside the outermost pinch roller, in order to perform imaging by illuminating the surface of the conveying roller outside of the contact area of the pinch rollers.

In the state in which the sheet P is nipped between the first conveying roller 36 and the pinch rollers 37, the direct-sensor unit 801 images the surface of the sheet P, to thereby measure the sheet conveyance (i.e. movement) amount. On the other hand, in the case where the sheet P is not nipped between the first conveying roller 36 and the pinch rollers 37, the direct-sensor unit 801 is capable of measuring the moving state of the surface of the roller by imaging the surface of the first conveying roller 36. Based on the moving state of the surface of the first conveying roller 36, the conveyance amount of the sheet P is estimated. The thus-obtained estimate value of the conveyance amount of the sheet P is more accurate than the estimate value of rotation of the rotary member obtained by the rotary encoder. This is because eccentricity with respect to the rotation axis or local lack of uniformity of the surface shape exists normally in the roller. It is impossible to detect those effects by the rotary encoder. However, by directly detecting the moving state of the surface of the roller by the direct sensor, it is possible to perceive the moving state including those effects.

The control unit is capable of recognizing, based on the image data obtained by the direct-sensor unit 801, whether the current object of measurement is the sheet or the surface of the roller. The surface state may be significantly different between the surface of the sheet and the surface of the roller, and hence it is possible to recognize, using an image recognition process, which surface is being sensed. The control unit performs control by causing the direct sensor unit to make different corrections in measurement output between the case in which the sheet is the object of measurement and the case in which the roller is the object of measurement.

FIGS. 4A to 4D are diagrams illustrating the conveyance of the sheet in a time sequence. The first conveying roller 36 is used as the rotary member which can be measured by the direct-sensor unit 801. As described above, the direct-sensor unit 801 is arranged so as to face the conveyance path for the sheet P and the first conveying roller 36 positioned on the upstream side of the print head 7.

Figure 4A:
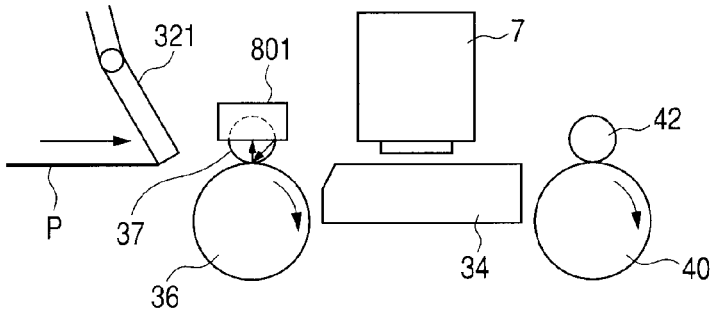
FIGS. 4A, 4B, 4C and 4D are diagrams illustrating conveyance of a sheet in time sequence.

FIG. 4A illustrates a state before the sheet P reaches the first conveying roller 36. In this state, the direct-sensor unit 801 is incapable of directly measuring the sheet P, but is capable of measuring the surface of the first conveying roller 36, and is thereby capable of accurately measuring the moving state of the surface of the first conveying roller 36. Based on the moving state of the surface of the first conveying roller 36 measured by the direct-sensor unit 801, it is possible to calculate the rotation amount of the first conveying roller 36. Therefore, by performing feedback control of the conveying motor 35, it is possible accurately to control the rotation amount of the first conveying roller 36, and it is thus possible to control the moving state of the surface thereof (and the eventual speed of the sheet that will be conveyed by the rotating roller). Further, there is provided the sensor lever 321 which rotates when the sheet P is in contact therewith, and hence it is possible to measure the position of the leading edge of the sheet P by the PE sensor 32 (see FIG. 2) for measuring the rotation operation of the sensor lever 321. From this measurement timing, it is possible to perform registration of the sheet P (i.e. parallel feeding registration of the first conveying roller 36 and the sheet P), and it is also possible to use the timing as information for determining a starting time and thereby position for printing.

Figure 4B:
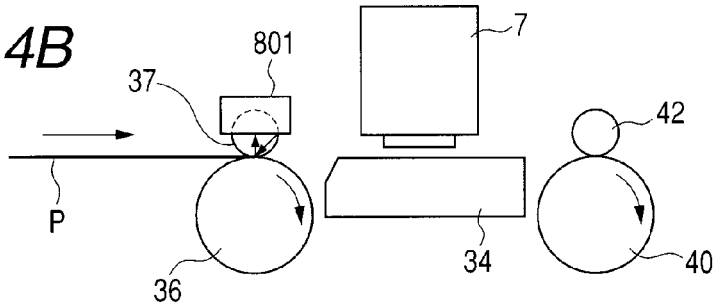

In FIG. 4B, when the sheet P reaches an upper portion of the first conveying roller 36, the sheet P appears directly below the direct-sensor unit 801. Therefore, the object of measurement by the direct-sensor unit 801 is switched from the surface of the first conveying roller 36 to the sheet P. In this case, even when the object of measurement is switched, it is possible to maintain the feedback control of the conveying motor 35 based on the output information of the direct-sensor unit 801. When the sheet P is not located directly below the direct-sensor unit 801, the rotation amount of the first conveying roller 36 is controlled. In contrast, when the sheet P is located directly below the direct-sensor unit 801, the conveyance amount of the sheet P is controlled.

Figure 4C:
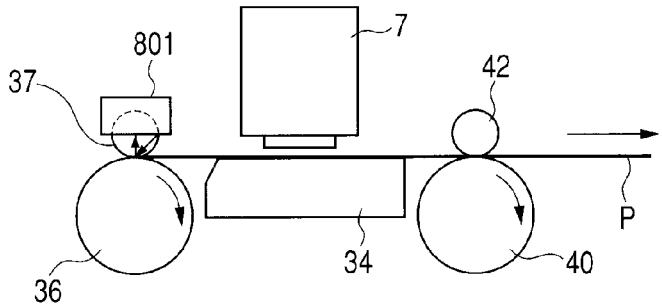

From the state shown in FIG. 4B to the state shown in FIG. 4C, the sheet P is nipped between the first conveying roller 36 and the pinch rollers 37 and conveyed thereby. Therefore, the direct-sensor unit 801 is capable of directly measuring the conveyance amount of the sheet P. Based on the information obtained by this measurement, the conveying motor 35 is subjected to feedback control, and the sheet P is accurately conveyed to a predetermined position and stopped at the position. As a result, high quality printing can be performed by the print head 7.

Figure 4D:
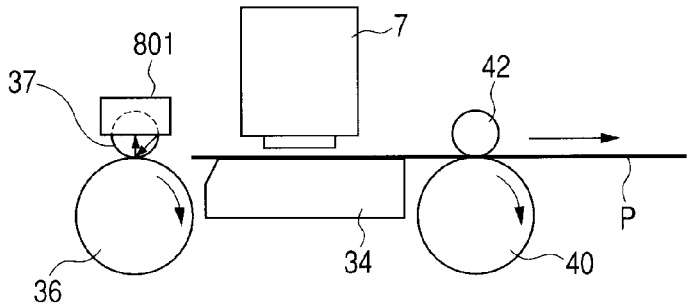

After that, as illustrated in FIG. 4D, the sheet P gets out of the position at which the sheet P is nipped between the first conveying roller 36 and the pinch rollers 37. As a result, the sheet P is nipped between the second conveying rollers 40 and the spurs 42 which are positioned on the downstream side compared with the print head 7, and is ready for conveyance.

In this state, the direct-sensor unit 801 is not in the state of directly measuring the sheet P. However, the direct-sensor unit 801 accurately measures the moving state of the surface of the first conveying roller 36 by direct sensing. Based on this measurement, the conveyance amount of the sheet is estimated. Further, based on the rotation amount of the first conveying roller 36, the rotation amount of the second conveying rollers 40 driven thereby is estimated.

After that, even after the completion of image formation, the direct-sensor unit 801 continuously measures the moving state of the surface of the first conveying roller 36. By performing the feedback control of the rotation amount of the first conveying roller 36 by the conveying motor 35, ejecting operation of the sheet P can be performed.

Even when measurement of the sheet P is impossible, the direct-sensor unit 801 measures the moving state of the surface of the first conveying roller 36. Therefore, the direct-sensor unit 801 calculates the rotation amount, thereby continuously to perform the feedback control. It is previously known that there is a difference between the moving state of the first conveying roller 36 and the moving state of the sheet P. Therefore, the rotation amount is controlled by correcting the measurement output so as to obtain the moving state of the surface of the first conveying roller 36, the moving state enabling the sheet P to be conveyed by a desired conveyance amount.

Further, the conveyance amount of the sheet P sometimes changes depending on type (with a difference in thickness, rigidity, and coefficient of friction) of the sheet P. Therefore, according to the type of the sheet to be used, the measurement output by the direct-sensor unit is corrected, thereby to perform control. Specifically, according to the type of the sheet P, the moving state of the surface of the first conveying roller 36 for obtaining the desired conveyance amount is determined in advance. Information on the type of the sheet P is received from a printer driver, a sensor for discriminating the types of the sheet, or the like. The measurement output is corrected so as to obtain the moving state of the surface of the first conveying roller 36 according to the received information, and then the rotation amount of the first conveying roller 36 is set.

Figure 5A:
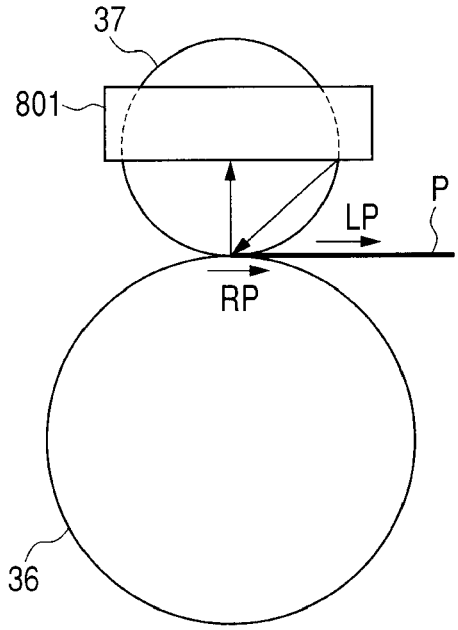
FIGS. 5A and 5B are enlarged views of a position at which measurement is performed by a direct-sensor unit.
Figure 5B:
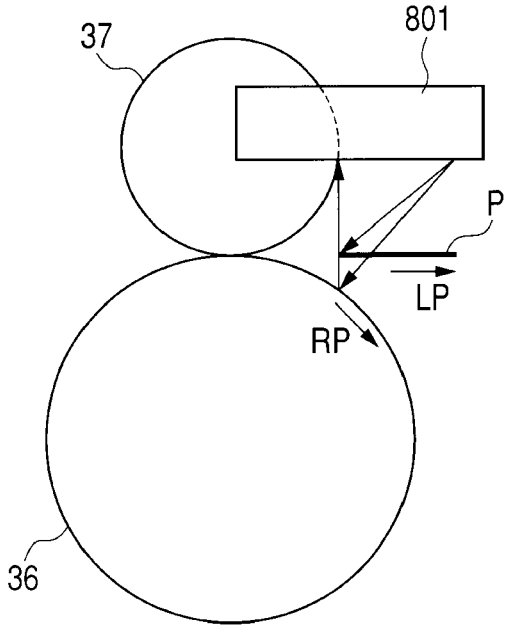

FIGS. 5A and 5B are enlarged views of a position at which detection is performed by the direct-sensor unit 801. As illustrated in FIG. 5A, in this embodiment, a vicinity of a position at which the sheet P comes into contact with the surface of the first conveying roller 36 is set as a measurement position (imaging position) for the direct-sensor unit 801. That is, a nipping position on the first conveying roller 36 at which the pinch rollers 37 come into contact therewith when viewed from a cross-sectional direction is set as the measurement position (imaging position) for the direct-sensor unit 801. Actually, it is impossible to perform imaging at the nipping position at which both the rollers are physically in contact with each other, because the pinch rollers physically obstruct imaging of the direct-sensor unit 801. Therefore, there is set as the measurement position a position which is on a line obtained by extending a line representing the nipping position (at which both the rollers are substantially in line-contact with each other because both rollers are cylindrical in shape and touch along a line). In other words, the sensor is positioned, as shown in FIG. 5A, on a line parallel to the axes of the conveying and pinch rollers, such that the sensor is able to measure the surface of the conveying roller 36, but further along this line than the pinch rollers 37 extend. For example, the sensor 801 may be positioned on the axis of the pinch rollers 37, but further along the axis to where the pinch rollers do not extend, but to where the conveying roller does (and thereby measures a surface of the conveying roller adjacent its end). Light from the conveying roller 36 received by the sensor 801 for imaging is transmitted toward the sensor from a direction perpendicular to the sheet P (and perpendicular to the detecting surface of the sensor). The direction of conveyance of the sheet P may be considered to be a tangent line with respect to the circumference of the first conveying roller 36 at the nipping position. When the imaging of the surface of the roller is performed from directly above the surface (i.e. in a direction of a perpendicular line from the surface), the surface of the roller, despite its cylindrical curved surface, can be regarded as substantially the same type of flat surface as the sheet P. Therefore, errors in measurement of the movement detection are reduced. A detection result of the sheet P is equal to a speed LP which is an actual speed of the sheet P, and a detection result of the roller 36 is equal to a circumferential speed RP which is an actual circumferential speed of the roller 36. As the nipping position between the rollers and the measurement position are substantially equal, the speed LP and the speed RP are equal. Note that the word "perpendicular" herein is a concept which is not strictly limited to 90° and includes a range of angles where the above-mentioned operations and effects can be realized. The above-mentioned operations and effects can be realized as long as the light reflected from the surface of the cylinder or sheet is within the imaging (i.e. receiving) surface of the image sensor included in the sensor 801.

If, as illustrated in FIG. 5B, the direct-sensor unit 801 performs the measurement at a position shifted significantly (perpendicularly) from the nipping position, the sheet P is seen by the sensor as floating above the detected surface of the first conveying roller 36. Therefore, the detected positions of the sheet P and the surface of the first conveying roller 36 are different. Further, imaging of the surface of the first conveying roller 36 is performed at an angle different from the perpendicular line as shown in FIG. 5B, because of the nonparallel surface of the roller with respect to the sensor's light-receiving surface. As a result, a large difference occurs in detection results between the movement detection of the sheet P and the movement detection of the surface of the first conveying roller 36. A detection result of the sheet P is the speed LP, however, a detection result of the roller 36 is smaller than the circumferential speed RP. As view from the sensor 801, a speed of the roller 36 in the conveyance direction of the sheet P becomes smaller than the circumferential speed RP, therefore the detection of the roller 36 is inaccurate. Further, in the image obtained by imaging the surface of the first conveying roller 36, blurring occurs at one side, which disturbs accurate detection of movement. In the present embodiment, such inconveniences do not exist thanks to the sensor being parallel to and aligned with the axes of the rollers and thus being effectively above the nipping portion. Further, in this embodiment, imaging of the nipping portion is substantially performed. Therefore, it is possible accurately to determine whether or not the first conveying roller 36 is nipping the sheet, and it is also possible to recognize accurately the feeding amount of the sheet at the time of registration.

The timing at which the sheet P emerges from the nipping position (as shown in FIG. 4C) between the first conveying roller 36 and the pinch rollers 37 can be measured directly by the direct-sensor unit 801. In this way, the sensor obtains information regarding the emergence of the sheet from the nipping position, such as information regarding changes in behaviour of the sheet P, e.g. a small separation of the sheet P from the platen 34. This information can be used to control the discharge of the ink. It is also possible to obtain information on a small shift in conveyance amount of the sheet P when the sheet P emerges from the nipping position and to feedback this information as a correction value such that the alignment or conveyance amount of the sheet may be corrected as the sheet P emerges from the nipping position.

It is possible to reduce the effects of the change in behaviour caused by the sheet P released from nipping by causing the direct-sensor unit 801 to measure the sheet P at a time immediately after the sheet P emerges from the nipping position so as to directly measure the conveyance amount of the sheet P. When especially aiming at such effects, the region to be measured by the direct-sensor unit 801 does not necessarily correspond to the nipping position, and the region on the downstream side in the vicinity of the nipping position may be set as the region to be measured.

Hereinafter, it is described that the same determination as described above is possible even if the sensor lever 321 and the PE sensor 32 (see FIG. 2) are not provided. In this case, the first conveying roller 36 has a structure in which a surface of a metal roller shaft is coated with alumina particles using a resin binder layer, and hence the first conveying roller 36 is a roller having extremely high (rough) surface roughness. This extremely high surface roughness enables strong-grip conveyance of the sheet. Generally, the surface of the sheet P is flat and smooth compared with the surface of the first conveying roller 36, and hence the images of the two surfaces obtained by imaging performed by the direct-sensor unit 801 are extremely different from each other. It is thus easy to discriminate the differences by image processing. By this discrimination, it is determined whether or not the sheet P exists directly below the direct-sensor unit 801. Furthermore, the leading edge of the sheet P may be measured based on the image obtained by imaging performed by the direct-sensor unit 801. Analysis of the image data by image processing enables the determination of whether or not the sheet P is conveyed directly below the direct-sensor unit 801. Similarly, it is also possible to measure the trailing edge of the sheet P so as to determine when the sheet P emerges from directly below the direct-sensor unit 801.

In the above-mentioned manner, the direct-sensor unit 801 measures the state illustrated in FIGS. 4B (and 4C). That is, it is detected that the sheet P reaches the nipping position between the first conveying roller 36 and the pinch rollers 37, which are opposite each other. After feeding out the sheet P by the predetermined amount, it is possible to perform the registration, which is effected by forming a loop of the sheet P by reverse rotation of the first conveying roller 36 with the sheet-supplying roller 28 being stopped. Further, since it is possible to measure the position of the leading edge of the print sheet P regardless of whether or not the registration is performed, it is also possible to determine the starting point for printing.

By arranging the direct-sensor unit 801 so as to be opposite (i.e. facing) the first conveying roller 36 as described above, it is possible to reduce a sensing disabled period during which the direct-sensor unit 801 is incapable of detecting anything.

Second Embodiment

FIGS. 6A to 6D are diagrams illustrating conveyance of a sheet in a time sequence according to a second embodiment of the present invention. At least one of the second conveying rollers 40 is used as the rotary member which can be measured by a direct-sensor unit.

The direct-sensor unit 801 is arranged so as to face the uppermost portion of at least one of the second conveying rollers 40 (rather than—or in addition to—the conveying roller 36). Similarly to the above-mentioned embodiment, the direct-sensor unit 801 and the spurs 42 are arranged in a positional relationship in which they are separated in the axial direction. It is possible to read the conveyance amount of the sheet P directly when the sheet P is conveyed while being nipped between the second conveying rollers 40 and the spurs 42. On the other hand, even when the sheet P is not nipped between the second conveying rollers 40 and the spurs 42, it is possible to measure accurately the moving state of the surface of at least one of the second conveying rollers 40 rotated synchronously with the first conveying roller 36. Therefore, the conveyance amount of the sheet P can be estimated.

Figure 6A:
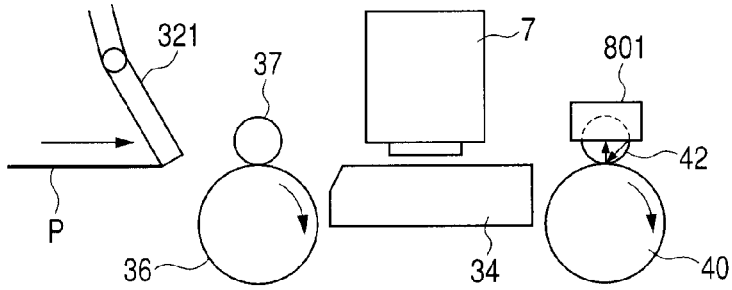
FIGS. 6A, 6B, 6C and 6D are diagrams illustrating conveyance of a sheet according to a second embodiment of the present invention in time sequence.

In FIG. 6A, there are provided the sensor lever 321 for measuring the leading edge and the trailing edge of the print sheet P and a PE sensor (not shown), and registration of the sheet P is performed appropriately as required. Then, the moving state of the surface of at least one of the second conveying rollers 40 is measured, thereby to estimate the conveyance amount of the sheet P so as to control the conveyance of the sheet P. When the sheet P exists directly below the print head 7, image formation is performed appropriately.

Figure 6B:
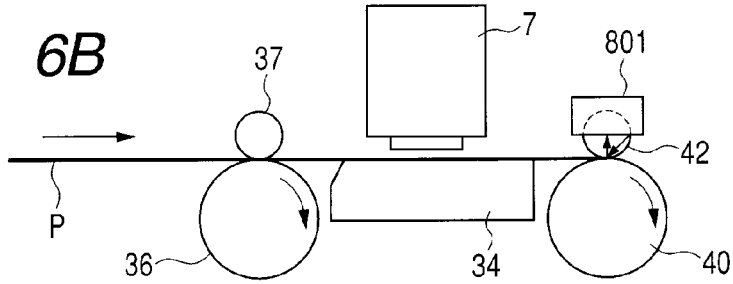

In FIG. 6B, when the sheet P is conveyed to the position at which the direct-sensor unit 801 is capable of performing measurement thereof (i.e. when the sheet P is nipped between the second conveying rollers 40 and the spurs 42), the sheet P is conveyed while the conveyance amount thereof is directly controlled, and then subjected to image formation.

Figure 6C:
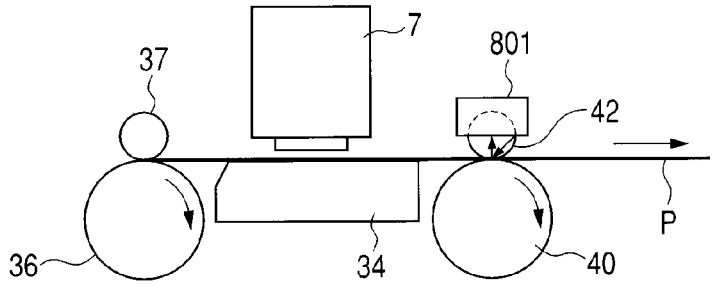

As illustrated in FIG. 6C, in a moment when the sheet P emerges from the nipping position between the first conveying roller 36 and the pinch rollers 37, and even after that moment of emergence, the measurement of the sheet P by the direct-sensor unit 801 can be continued uninterruptedly. This is a merit of this embodiment. Because of this merit, it is possible to suppress the change in conveyance amount, which tends to occur in a moment when the sheet P emerges from the nipping position between the first conveying roller 36 and the strongly-pressed pinch rollers 37. Further, even after the moment of emergence, the conveyance amount of the sheet P can be directly measured. Therefore, also in the case of performing borderless printing on the trailing edge of the sheet, it is possible to perform image formation while continuing the accurate conveyance to the end.

Figure 6D:
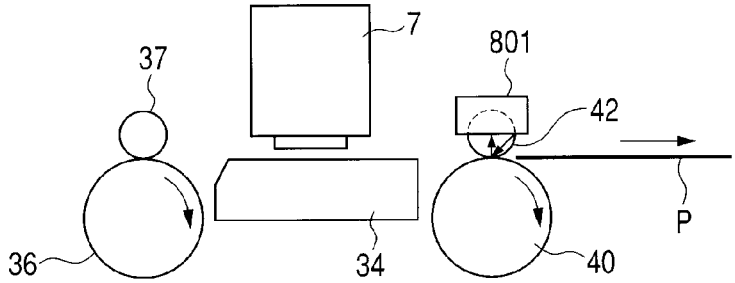

After the state illustrated in FIG. 6D, the conveyance of the sheet P does not involve image formation on the sheet. The moving state of the surface of at least one of the second conveying rollers 40 is measured so as to control rotation of the second conveying rollers 40, and the print sheet P is ejected. At this time, the direct-sensor unit 801 may determine whether or not the sheet P is properly ejected, and the conveyance operation may be changed or stopped based on the information.

According to this embodiment, it is possible easily to improve the conveyance accuracy in the moment when the sheet P is released from the nipping by the first conveying roller 36 and the pinch rollers 37 using a single direct-sensor unit 801.

Third Embodiment

FIGS. 7A to 7D are diagrams illustrating conveyance of the sheet in a time sequence according to a third embodiment of the present invention. A rotation measurement roller 602 is the rotary member which can be measured by the direct-sensor unit.

The direct-sensor unit 801 is arranged so as to face the rotation measurement roller 602 rotatably attached to the platen 34. The rotation measurement roller 602 faces the sheet P and is near to the sheet without touching it. The rotation measurement roller 602 receives a force transmitted from the first conveying roller 36 via a drive transmission gear system 601, and is mechanically geared with the first conveying roller 36, to synchronously rotate with it. The rotation measurement roller 602 rotates at a circumferential velocity equal to the circumferential velocity of the first conveying roller 36. Note that the driving source of the rotation measurement roller 602 may not be the first conveying roller 36, but be the second conveying rollers 40 operated synchronously with the first conveying roller 36, or be a transmitting unit mechanically operated synchronously with the conveying roller 36 and the pinch rollers 37. The direct-sensor unit 801 is installed on the carriage 50, or arranged at a position which does not interfere with the carriage 50.

When the sheet P is conveyed while being located on the rotation measurement roller 602, it is possible to read the conveyance amount of the sheet P directly. On the other hand, even when the sheet P is not located on the rotation measurement roller 602, it is possible to measure the moving state of the uppermost surface of the rotation measurement roller 602. It is thereby possible to estimate the moving state of the sheet P based on this moving state of the surface of the rotation measurement roller 602.

Figure 7A:
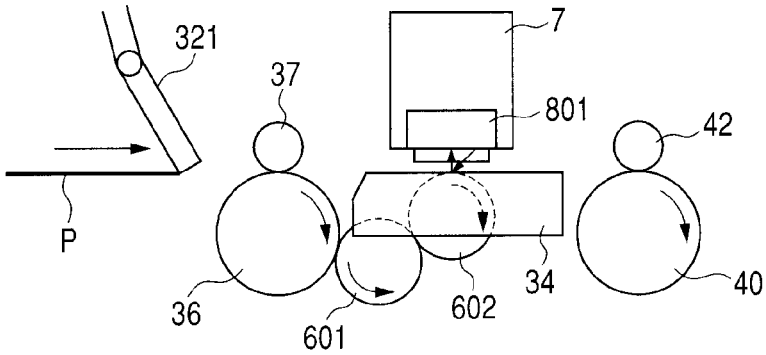
FIGS. 7A, 7B, 7C and 7D are diagrams illustrating conveyance of a sheet according to a third embodiment of the present invention in time sequence.
Figure 7B:
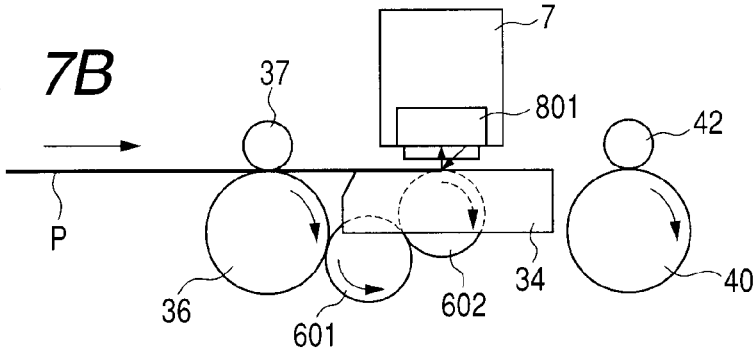
Figure 7C:
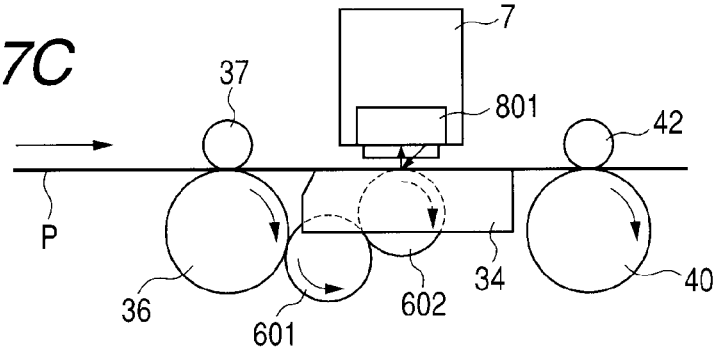
Figure 7D:
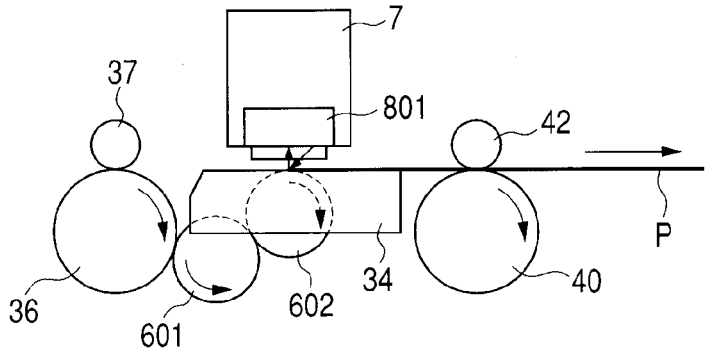

The direct-sensor unit 801 is arranged in a nozzle row of the print head or in the vicinity thereof. Therefore, in the almost entire region in which the image is formed on the sheet P as illustrated in FIGS. 7B and 7C, the conveyance amount of the sheet P can be directly measured by the direct-sensor unit 801. The range within which the conveyance amount of the sheet P cannot directly be measured and is to be estimated by the rotation amount of the rotation measurement roller 602 is extremely small. Therefore, it is possible to minimize deterioration in accuracy.

In this embodiment, the rotation measurement roller 602 does not come into contact with the sheet P, and is arranged at a position adjacent to the sheet P. In the case of non-contact, the conveyance of the sheet P is not affected by contact of the rotation measurement roller 602 with the sheet P. The rotation measurement roller 602 may come into contact with the sheet P. In this case, the position of the sheet P and the measurement position (i.e. the uppermost portion) of the rotation measurement roller 602 is at the same height, and hence an imaging optical system can be designed easily (i.e. the depth of field can easily be set).

Fourth Embodiment

Figure 8A:
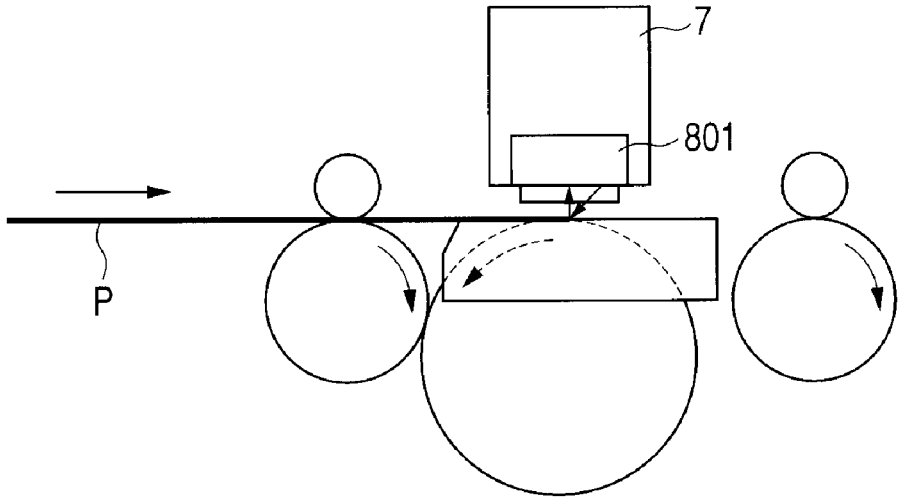
FIGS. 8A and 8B are diagrams illustrating conveyance of a sheet according to a fourth embodiment of the present invention in time sequence.
Figure 8B:
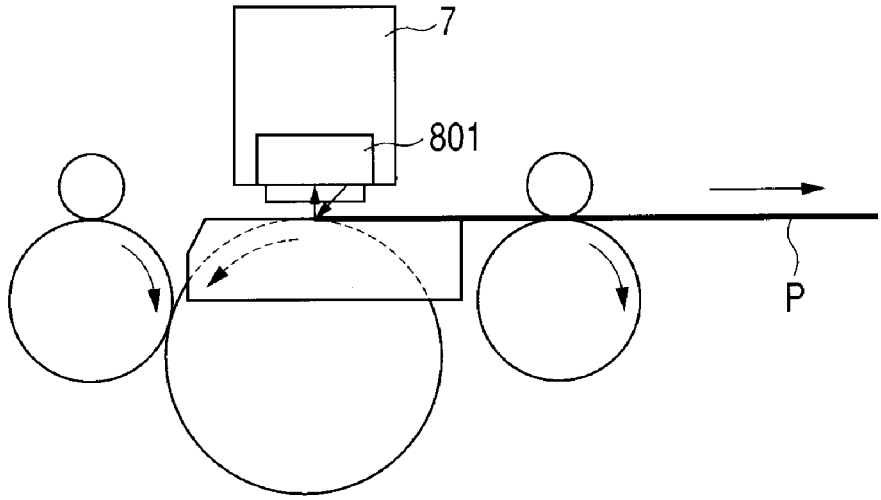

FIGS. 8A and 8B are diagrams illustrating conveyance of the sheet according to a fourth embodiment of the present invention in time sequence. Similar to the third embodiment, the rotation measurement roller 602 is used as the rotary member that can be measured by the direct-sensor unit. However, the fourth embodiment is different from the third embodiment in that the rotation measurement roller 602 rotates in a reverse direction from the conveyance direction of the sheet P. The rotation measurement roller 602 is operated mechanically and synchronously with the first conveying roller 36, and driven so as to reversely rotate at the circumferential velocity equal to the circumferential velocity of the first conveying roller 36. In order to cause the rotation measurement roller 602 to rotate reversely, it is sufficient to reduce or increase the number of idler gears by one compared with the drive transmission gear train of FIGS. 7A to 7D.

Reverse rotation of the rotation measurement roller 602 greatly facilitates discrimination by image processing whether the object measured by the direct-sensor unit 801 is the sheet P or the rotation measurement roller 602.

In the embodiments described above, the direct sensor which measures the moving state based on the image data obtained by imaging performed by the image sensor is exemplified as the sensor unit. However, the present invention is not limited to this mode, and it is also possible to use a direct sensor of another type, which may directly measure the moving state of an object by optically detecting the surface of the object. For example, a Doppler velocity sensor may be used. The Doppler velocity sensor, which includes a coherent light source (such as a laser) and a light-receiving element, measures the moving speed of the object by receiving light reflected from the object which is irradiated with light and by capturing the phenomenon of movement of the object causing a Doppler shift in a light-receiving signal. The direct-sensor unit 801 in each of the above-mentioned embodiments may be replaced by the Doppler velocity sensor, to thereby measure the moving state of the sheet or a rotary member at the same measurement position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-320811, filed Dec. 17, 2008, which is hereby incorporated by reference herein in its entirety.

What is claimed is:

1. A printing apparatus, comprising:

a conveying mechanism configured to convey a sheet, the conveying mechanism comprising a rotary member; and a sensor unit configured to optically detect at a measurement position on the rotary member, wherein the sensor unit is further configured to measure a moving state of the sheet when the sheet is located at the measurement position, and to measure a moving state of a surface of the rotary member when the sheet is not located at the measurement position, and wherein the sensor unit comprises at least one of (1) an image sensor arranged to perform imaging of one of the surface of the sheet and the surface of the rotary member so as to obtain image data, based on which the moving state is measured and (2) a Doppler velocity sensor.

2. A printing apparatus according to claim 1, wherein the measurement position is at a position at which the rotary member comes into contact with the sheet.

3. A printing apparatus according to claim 1, wherein the conveying mechanism further comprises a pinch roller arranged such that the pinch roller and the rotary member are arranged to nip the sheet between them, the pinch roller being shorter along its rotational axis than the rotary member; and wherein the measurement position is at a position on the surface of the rotary member that extends beyond the length of the pinch roller.

4. A printing apparatus according to claim 1, wherein the conveying mechanism further comprises a series of pinch rollers aligned on a common axis and arranged such that the pinch rollers and the rotary member are arranged to nip the sheet between them; and wherein the measurement position is at a position on the surface of the rotary member that is between adjacent pinch rollers.

5. A printing apparatus according to claim 1, wherein the sensor unit is configured to perform imaging of the measurement position from a direction perpendicular to the surface containing the measurement position.

6. A printing apparatus according to claim 1, further comprising:

a print head, wherein the sensor unit is positioned upstream of the print head in a sheet-conveying direction.

7. A printing apparatus according to claim 1, further comprising:

a print head, wherein the sensor unit is positioned downstream of the print head in a sheet-conveying direction.

8. A printing apparatus according to claim 1, further comprising:

a print head; and a platen facing the print head and arranged to support the sheet to be printed on by the print head, wherein the sensor unit is positioned at or adjacent the print head; and the rotary member is incorporated into the platen.

9. A printing apparatus according to claim 1, wherein the rotary member comprises a rotation measurement roller which is mechanically operated together with a conveying roller, the conveying roller being for conveying the sheet, and the rotation measurement roller rotating synchronously with the conveying roller.

10. A printing apparatus according to claim 9, wherein the rotation measurement roller rotates in a reverse direction compared with the rotating direction of the conveying roller.

11. A printing apparatus according to claim 1, further comprising a control unit configured to perform control of at least one of the conveying mechanism, the sensor unit and a print unit based on the moving state of the sheet or the rotary member measured by the sensor unit.

12. A printing apparatus according to claim 11, wherein the control unit is configured to correct a measurement output by the sensor unit when the object of measurement is the rotary member.

13. A printing apparatus according to claim 11, wherein the control unit is configured to correct measurement output by the sensor unit according to a type of the sheet to be used.

14. A conveying apparatus comprising:

a conveying mechanism arranged to convey a sheet, the conveying mechanism comprising a rotary member; and a sensor unit arranged to optically detect at a measurement position on the rotary member, wherein the sensor unit is configured to measure a moving state of the sheet when the sheet is located at the measurement position, and to measure a moving state of a surface of the rotary member when the sheet is not located at the measurement position, and wherein the sensor unit comprises at least one of (1) an image sensor arranged to perform imaging of one of the surface of the sheet and surface of the rotary member so as to obtain image data, based on which the moving state is measured and (2) a Doppler velocity sensor.

* * * * *